United States Patent [19]

Bilicki

[11] Patent Number: 4,856,520

[45] Date of Patent: Aug. 15, 1989

[54] TANNER'S PLATFORM

[76] Inventor: Donald G. Bilicki, 3066 Castleton Way, Marietta, Ga. 30062

[21] Appl. No.: 166,465

[22] Filed: Mar. 10, 1988

[51] Int. Cl.[4] ..... A61H 33/06

[52] U.S. Cl. ..... 128/372; 128/396; 116/73

[58] Field of Search ..... 128/372, 376, 345, 396, 128/371, 373; 108/20, 22, 139; 219/217; 116/73, 158, 162

[56] References Cited

U.S. PATENT DOCUMENTS

| | | | |
|---|---|---|---|
| 1,319,722 | 10/1919 | Muir | 116/73 |
| 1,974,820 | 9/1934 | Krell | 128/395 |
| 3,496,941 | 2/1970 | Ketner | 128/395 |
| 3,646,896 | 3/1972 | Derujinsky et al. | 5/419 |
| 3,713,619 | 1/1973 | Marty | 248/425 |
| 4,140,128 | 2/1979 | Van Der Schaff | 128/376 |
| 4,205,684 | 6/1980 | Lassy | 128/372 |
| 4,279,254 | 7/1981 | Boschetti et al. | 128/395 |
| 4,379,588 | 4/1983 | Speice | 128/372 |
| 4,469,951 | 9/1984 | Colo et al. | 128/371 |

FOREIGN PATENT DOCUMENTS

| | | | |
|---|---|---|---|
| 353266 | 7/1931 | United Kingdom | 128/372 |

*Primary Examiner*—Edward M. Coven
*Assistant Examiner*—Mark S. Graham
*Attorney, Agent, or Firm*—Thomas & Kennedy

[57] ABSTRACT

An apparatus for safe and even tanning of a tanner comprises a disc shaped bed rotatably supported upon a disc shaped base. A drive system is adapted to rotate the bed with respect to the base at a predetermined rate such that a tanner lying on the bed beneath the source of tanning radiation receives uniform exposure. A reflector attached to the periphery of the bed reflects tanning radiation toward the sides of a tanner lying on the bed and an alarm responsive to the rotation of the bed produces an audible attention signal upon the completion of a predetermined number of rotations of the bed.

2 Claims, 3 Drawing Sheets

28
27
10
13
14
24
11
12
16

10
28
29
11
27
26
14
14
26
24
19
12
21
18
16
23
22
17
16
37
16
36
38

TANNER'S PLATFORM

TECHNICAL FIELD

The present invention relates generally to tanning and particularly to rotatable platforms for supporting a tanner beneath a source of tanning radiation.

BACKGROUND OF THE INVENTION

Sun bathing or tanning has been a popular recreational activity for many years. A tanner will typically lie in a lounge chair or on a towel placed in the sunshine such that the ultraviolet rays of the sun cause the skin of the tanner to darken. There has also been a proliferation of tanning parlors, which utilize artificial sources of ultraviolet radiation rather than the sun for tanning. It is highly desirable that the various portions of a tanner's body receive roughly equal exposure to the tanning radiation in order that the tanner receive an even tan.

To ensure even exposure to the tanning radiation, a tanner must typically change his or her position periodically by rising from the towel or lounge chair, moving the same with respect to the position of the radiation source, and repositioning him or herself on the towel or chair. Despite such efforts, portions of a tanner's body will generally receive less exposure and consequently be less tanned than other portions of the body because the radiation is generally downwardly directed. This is particularly true when tanning outdoors in the sunshine.

A danger inherent in any such tanning routine is that of lack of attention on the part of the tanner, often as a result of falling asleep, which may and often does, result in severe overexposure to the radiation and consequently uncomfortable or dangerous burning of the skin.

Attempts have been made to solve the problems associated with tanning. U.S. Pat. No. 3,646,896 of Derujinsky et al illustrates a rotatable platform upon which a tanner lies beneath a source of tanning radiation. A tanner lying on the Derujinsky device can manually rotate the platform while lying thereon to reposition him or herself with respect to the tanning rays.

While the Derujinsky device provides for more convenient tanning than traditional methods, many of the problems associated with tanning are not solved by the device. The tanner must still decide when and to what degree to rotate the platform and must manually rotate it by pressing on the ground or other surface adjacent the platform. Uneven tanning due to generally downwardly directed tanning rays, particularly when tanning in the sun, remains a problem when using the device of Derujinsky. Should the tanner fall asleep or otherwise lose attention while tanning on the Derujinsky device, the danger of overexposure to the radiation and consequent burning remains present. It is, therefore, to the provision of a safe and even tanning method apparatus that overcomes the problems associated with the prior art to which the current invention is primarily directed.

SUMMARY OF THE INVENTION

The present invention is an apparatus for use by sunbathers or tanners adapted to provide each part of the tanner's body with substantially equal exposure to the tanning radiation from the sun or other radiation source thereby insuring an even and uniform tan. In addition, the apparatus is adapted to produce an attention signal at predetermined intervals to insure that the tanner, if he falls asleep or if his attention wanders, he is alerted to the possibility of overexposure. The signal also informs the tanner when to turn over to expose some other portion of his or her body to the tanning radiation.

The invention comprises a circular bed that is rotatably supported upon a circular base. A drive means is adapted to rotate the bed with respect to the base at a predetermined angular rate. An inverted substantially frusto-conical reflector extends upwardly and outwardly from the periphery of the bed and is oriented to reflect the generally downwardly directed tanning radiation in a generally lateral direction toward a tanner lying on the bed. The top surface of the bed is also covered with reflecting material to improve the distribution of reflected radiation. An alarm that is responsive to the rotation of the bed is adapted to produce an audible signal after a predetermined number of rotations of the bed to alert the tanner and aid him or her in determining when to turn over to expose other portions of his or her body to the tanning radiation.

In operation, a tanner lies on the upper surface of the bed beneath a source of tanning radiation. The bed and tanner are rotated by the drive means at a predetermined angular rate with respect to the base. As the tanner rotates, generally downwardly directed tanning rays are distributed evenly over upwardly facing portions of the tanner's body. Tanning rays falling on the reflector portions of the platform are reflected generally toward laterally facing portions of the tanner's body. This reflection combined with the rotation of the tanner insures that each exposed portion of the tanner's body receives substantially equal exposure to the tanning radiation resulting in an even tan.

The alarm is adapted to sound an audible attention signal after a predetermined number of complete revolutions of the bed. In addition to alerting a tanner, who may have fallen asleep, the signal aids the tanner in deciding when to turn over to expose other portions of his or her body to the tanning radiation.

Thus, a tanning platform is provided that ensures that all portions of a tanner's body receives substantially equal exposure to the tanning radiation resulting in an even tan. An audible alarm is provided to alert the tanner to the dangers of overexposure and to aid in determining when to turn over to expose other portions of a tanner's body to the tanning radiation.

DETAILED DESCRIPTION

Figure 1:
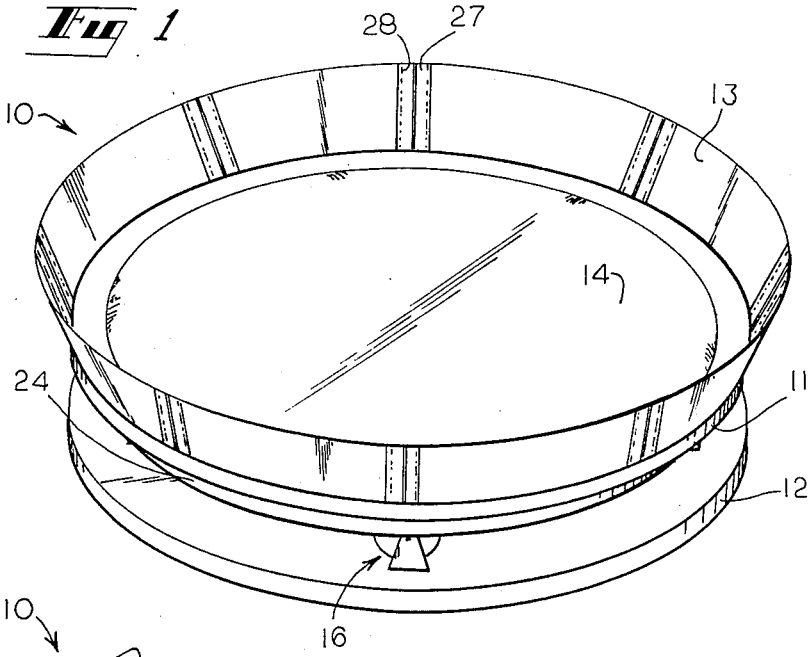
FIG. 1 is a perspective view of the tanner's platform.
Figure 2:
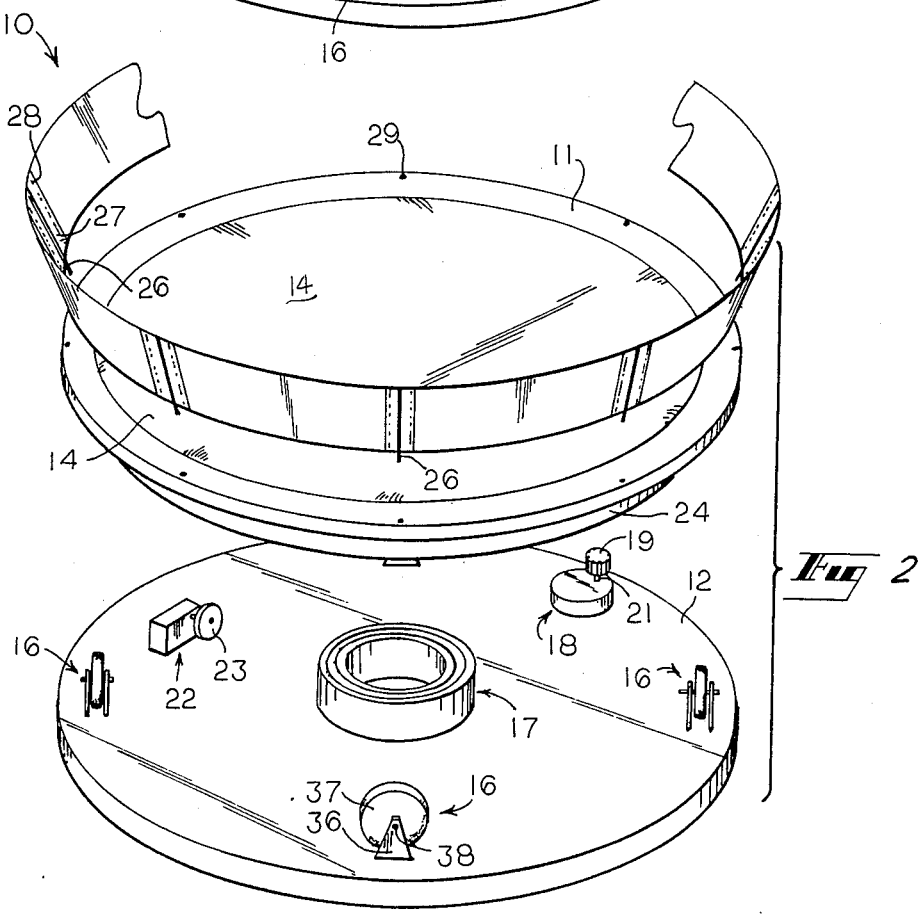
FIG. 2 is an exploded perspective view showing the removable reflector.

Referring now in more detail to the drawings, in which like numerals represent like parts throughout the several views, FIG. 1 shows the tanning platform 10 comprising a disc shaped bed 11 that is rotatably mounted upon a disc shaped base 12. Inverted substantially frustro-conical reflector 13 is seen to extend upwardly and outwardly from a peripheral edge of the bed 11. Reflector 13 is releasibly attached to the bed 11 via a plurality of support rods 26 that are adapted to fit into support rod receiving holes 29 adjacent the periphery of the bed. While reflector 13 may be constructed of any suitably reflecting material, a preferred embodiment is made from a diffusly reflective white fabric that can be folded and/or rolled up and stored when not in use. The support rods 26 are attached to the reflector via attaching strips 27 and extend from the upper edge of the reflector to a point below the lower edge of the reflector as seen in FIG. 2. In this way, the reflector is releasibly attached to the bed when the lower end of the support rods are placed in the support rod receiving holes 29 and the support rods maintain the reflector in its upright configuration.

As seen in FIG. 2, the upper surface of the bed 11 is covered with reflecting material 14. Underlying reflecting material 14 is preferably a padding material (not shown) such that a tanner may lie comfortably upon the bed. The padding material may be of any conventional type such as a foam rubber pad.

Figure 3:
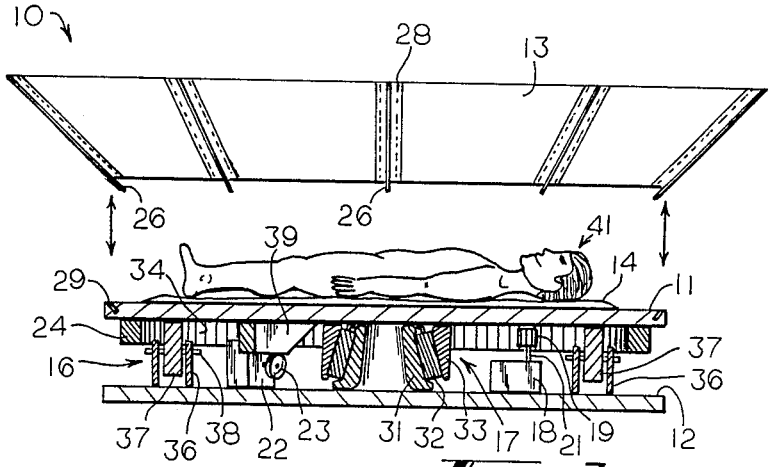
FIG. 3 is a side elevation partially in section showing the roller bearing, the rollers, the drive means, and the alarm means.

Annular gear ring 24 extends downwardly from the lower surface of the bed 11 adjacent its periphery and has a plurality of gear teeth 34 formed around the inner circumference thereof (FIG. 3). A roller bearing 17 having an inner race 31 connected to the upper surface of the base 12 and an outer race 33 connected to the lower surface of the bed 11 and having roller bearings 32 between the races is located coaxially with respect to the base and bed. The roller bearing 17 is of generally conventional construction and serves to support the central portion of the bed while allowing the bed to rotate with respect to the base. A plurality of support rollers 16 extend upwardly from the base. The support rollers 16 have a pair of support stanchions 36 and a roller member 37 attached to the stanchions via pin 38 such that the roller member is free to rotate about the pin between the stanchions. The roller members 37 bear against the lower surface of the bed 11 radially inwardly from the annular gear ring 24 such that the peripheral portions of the bed are supported by the support rollers while the rollers facilitate rotation of the bed 11 with respect to the base 12.

Drive means 18 including drive shaft 21 and pinion 19 is attached to base 12 as seen in FIGS. 2 and 3. Drive means 18 is positioned to insure that the teeth of pinion 19 mesh with the teeth formed in the annular gear ring 24 such that rotation of the pinion 19 under the influence of the drive means 18 causes the bed 11 to rotate with respect to the base 12. Drive means 18 may be of any conventional construction such as an electric motor rotatably coupled to the drive shaft 21 via reduction gears. Electric power for such a drive means could be supplied from conventional household current, batteries, or by an array of solar voltaic cells placed in the sunshine. Alternatively, drive means 18 could comprise a fluid turbine adapted to be powered by fluid pressure from, for example, a conventional garden hose. Such turbines are well known and commonly comprise a rotor and a plurality of impeller blades against which the fluid impinges to rotate the rotor. The rotor is in turn rotatably connected to the drive shaft 21 and pinion 19 through conventional reduction gears.

Alarm means 22 is attached to the upper surface of base 12 and includes frictional winding wheel 23. Alarm means 22 is of conventional spring powered construction and is adapted to be wound when the frictional winding wheel 23 is rotated and to sound an alarm upon the wheel being released. As seen in FIG. 3, track 39 extends downwardly from the lower surface of the bed 11. The track 39 is formed in the shape of an arc with the lower surface of the track being in frictional engagement with the winding wheel 23 when the track 39 and the wheel 23 are radially aligned. With this construction, it can be seen that as bed 11 rotates with respect to base 12, track 39 will come into frictional contact with wheel 23 once for each revolution of the bed 11. As the bed 11 rotates with the track 39 in frictional engagement with the wheel 23, the wheel is rotated by the movement of the track such that the spring within the alarm means 22 is wound. As the bed 11 rotates further, track 39 moves past wheel 23 such that the wheel is no longer in frictional engagement with the lower surface of the track. At this point, the spring that has been wound by the action of the track and the wheel unwinds causing the spring powered alarm means 22 to sound an audible attention signal. Alternatively, the alarm means 22 may be adapted to sound an attention signal only after a predetermined number of revolutions of the bed 11 with respect to the base 12.

OPERATION

Figure 4:
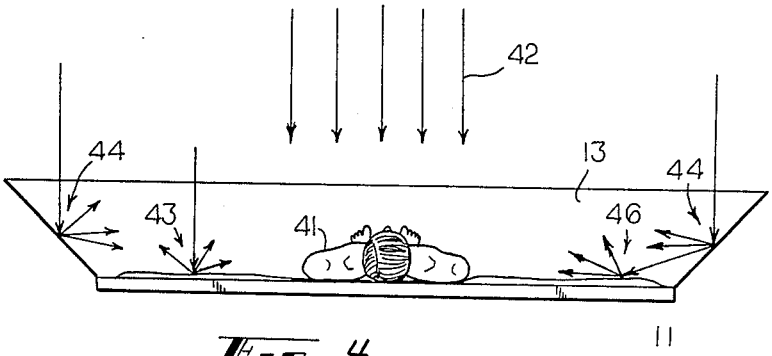
FIG. 4 shows the direction and reflections of tanning rays falling vertically on a tanner lying on the bed.
Figure 5:
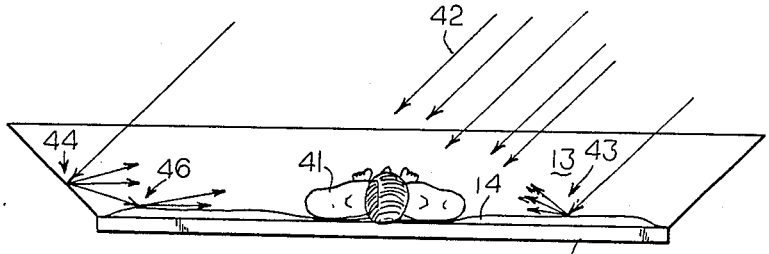
FIG. 5 illustrates directions and reflections of tanning rays falling on a tanner from an angle.

When using the tanning platform, a tanner lies on the upper surface of the bed 11 beneath a source of tanning radiation such as the sun. The tanner's body is generally oriented along a diameter of the bed 12 as illustrated in FIGS. 4, 5 and 6. When activated, the drive means 18 causes the bed 11 to rotate with respect to the base 12 and with respect to the tanning rays 42. When the tanning rays 42 originate from a vertically positioned source as illustrated in FIG. 4, some of the rays fall directly onto the tanner 41 tending to tan the upper portion of the tanner's body only. Other tanning rays fall on the diffusively reflecting pad 14 as illustrated at 43 in FIG. 4. These rays are diffusively reflected by the pad such that a portion of the reflected rays fall on the side portions of the tanner's body. Still other tanning rays fall on the reflector 13 as illustrated at 44. These rays are diffusely reflected as illustrated in a direction generally toward the side portion of the tanner's body. Finally, a portion of the radiation reflected from the reflector falls onto the reflecting pad as illustrated at 46. These rays are reflected again by the pad such that a portion of them falls on the sides of the tanner's body. It can be seen that the side portions of a tanner's body that normally receive relatively small exposure to the tanning rays 42 are exposed to tanning rays reflected from the reflector 13 and the reflector pad 14 when a tanner is lying on the tanning platform. While the tanning rays may not be evenly distributed over the tanner's body for a particular orientation of the platform, the differences in exposure will be averaged in time as the platform rotates resulting in uniform exposure for each exposed part of the tanner's body.

In FIG. 5, the tanning rays 42 are illustrated falling on a tanner 41 from an oblique angle. In this situation, neither the direct rays nor the reflected rays are uniformly distributed for a particular orientation of the platform. In this case, exposure to direct rays as well as the reflected rays is averaged as the platform rotates such that, again, each exposed portion of the tanner's body receives substantially equal exposure to the tanning radiation resulting in an even tan.

Figure 6A:
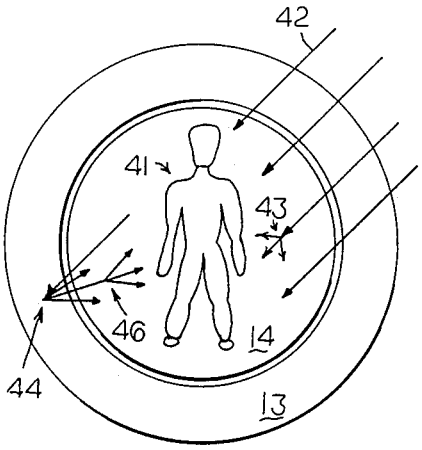
FIGS. 6A through 6D illustrate the orientation of a tanner with respect to the tanning rays at several positions of the bed.
Figure 6B:
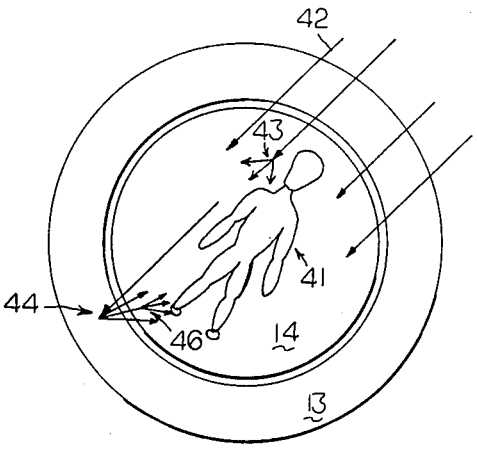
Figure 6C:
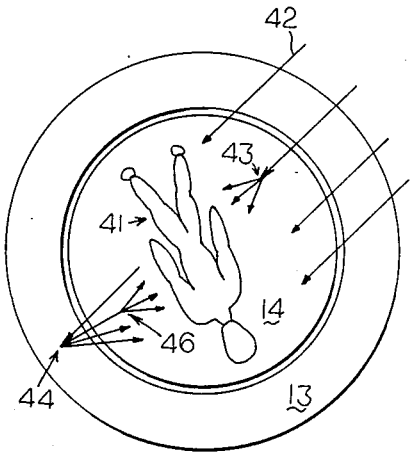
Figure 6D:
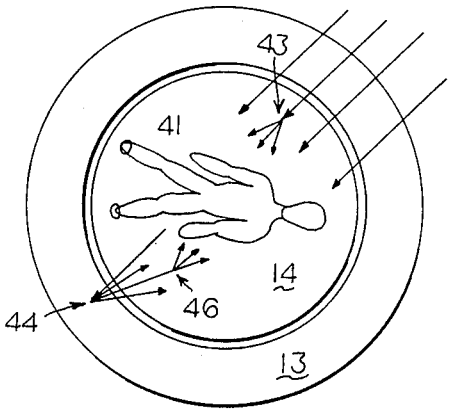

FIGS. 6A through 6D illustrate the varying positions of a tanner with respect to tanning rays 42 as the bed 11 rotates. The tanning rays 42 are impinging from an arbitrary angle and reflections of the rays from the reflector and the reflecting pad are illustrated at 44, 43 and 46. In FIG. 6A, the tanner 41 receives substantially more exposure to radiation on the left side of his body than on the right. In FIG. 6B, the tanner receives greater exposure on the upper portions of his body and when the tanner has rotated to the position of FIG. 6D, the right side of his body begins to receive relatively more exposure to the radiation. In FIG. 6C, the tanner is oriented such that the right side of his body receives substantially the same exposure to radiation as the left side of his body received in the position illustrated in FIG. 6A.

It can be seen from FIGS. 6A–6D that as the platform and tanner rotate with respect to the radiation, differences in exposure to the radiation are averaged such that at the end of one complete revolution, each exposed portion of the tanner's body has received substantially identical exposure to the tanning radiation. The result is a uniform tan extending to portions of the body that, traditionally, receive very little tanning radiation such as, for example, the eye sockets and under the chin.

In order to tan unexposed portions of the tanner's body, he or she must periodically turn over to expose these portions to the tanning radiation. Alarm means 22 being activated at substantially equal time intervals, provides an aid to the tanner in determining when to turn over such that all parts of the body receive substantially equal exposure. In addition, since alarm means 22 is activated only after a predetermined number of complete revolutions of the bed, a tanner turning over at the alarm will ensure that he or she receives the same number of averaged, even exposures to the tanning radiation. The overall result is an even and uniform tan over the tanner's entire body.

The alarm means also provides an audible attention signal for alerting a tanner should he fall asleep or otherwise lose attention to help reduce the chances of overexposure and burning.

While various rates of rotation of the bed with respect to the base may prove satisfactory, it is believed that a rate of one rotation each 4 to 6 minutes will be a convenient time interval for the tanner and will adequately account for movement of the sun. In addition, a preferred angle of the frustro-conical reflector is in the range of 130–150 degrees, preferably 145 degrees with respect to the upper surface of the bed.

Although the invention has been described in the form of a preferred embodiment, many modifications, additions, and deletions may be made thereto without departing from the spirit and scope of the invention as set forth in the claims.

I claim:

1. An apparatus for safe and even tanning of a tanner comprising disk-shaped first means for supporting the tanner in a generally horizontal position beneath a source of tanning radiation, a base member for supporting said first means, drive means for rotating said first means at a predetermined angular rate with respect to said base member, radiation reflecting means for reflecting tanning radiation in a direction generally toward the central portion of said first means, and signaling means adapted to produce an attention signal in response to a predetermined number of complete rotations of said first means relative to said base, said radiation reflecting means comprising an inverted substantially frustroconical radiation reflector releasibly attached to the peripheral portion of said first means and a reflective pad positioned at least partially to cover the central portion of said first means, said radiation reflector extending upwardly and outwardly from the periphery of said first means whereby radiation incident on the apparatus is reflected by the reflector and reflective pad in a direction generally toward a tanner supported on said first means.

2. The apparatus of claim 1 wherein said reflector extends upwardly at an angle in the range of 130 to 140 degrees with respect to the surface of said first means.

* * * * *